US006672098B2

(12) United States Patent
Norris

(10) Patent No.: US 6,672,098 B2
(45) Date of Patent: Jan. 6, 2004

(54) CHILLER/COOLER

(75) Inventor: David A. Norris, Cambridgeshire (GB)

(73) Assignee: D C Norris & Co. (Engineering) Limited, Bedfordshire (GB)

( * ) Notice: Subject to any disclaimer, the term of this patent is extended or adjusted under 35 U.S.C. 154(b) by 0 days.

(21) Appl. No.: 10/359,718

(22) Filed: Feb. 7, 2003

(65) Prior Publication Data

US 2003/0150221 A1 Aug. 14, 2003

(30) Foreign Application Priority Data

Feb. 13, 2002 (GB) ..... 0203405
Jul. 10, 2002 (GB) ..... 0216012

(51) Int. Cl.[7] ..... F25D 17/02; F25D 25/04
(52) U.S. Cl. ..... 62/374; 62/380; 198/952
(58) Field of Search ..... 62/374, 380, 63, 62/64; 198/952, 802, 469.1, 463.2, 465.3

(56) References Cited

U.S. PATENT DOCUMENTS 2,950,605 A * 8/1960 Hennion ..... 62/250
3,302,423 A * 2/1967 Morrison ..... 62/266
3,832,864 A 9/1974 Rasovich
4,128,164 A * 12/1978 Sandberg ..... 198/813
4,403,479 A 9/1983 Rasovich
4,955,209 A * 9/1990 Smith ..... 62/380
4,992,289 A * 2/1991 Kiczek ..... 426/479
5,509,277 A * 4/1996 Kiczek et al. ..... 62/374
RE35,243 E * 5/1996 Tolson ..... 198/343.1
5,860,282 A 1/1999 Liberman et al.

* cited by examiner

*Primary Examiner*—William C. Doerrler
(74) *Attorney, Agent, or Firm*—Ralph A. Dowell; Dowell & Dowell PC

(57) ABSTRACT

A chiller comprises a vessel for coolant and an endless conveyor having transverse flights. The conveyor passes in a loop from one side to another of the vessel. An arrangement is provided to alter the path of the conveyor so as to shorten and lengthen the loop. In use, when the loop is lengthened articles are tumbled in the coolant by the flights, and when the loop is shortened articles are conveyed out of the vessel.

8 Claims, 3 Drawing Sheets

CHILLER/COOLER

BACKGROUND OF THE INVENTION

The invention relates to chillers (which may alternatively be referred to as coolers), particularly for bagged food products, of the type in which the bags are made to tumble in a bath of liquid coolant. Liquid or semi-liquid food products, such as soups and sauces, may be packaged after cooking in sealed plastic bags. In order to reduce the temperature of the food product, the bags may be introduced into a tumble chiller consisting of a drum which contains a coolant such as water or brine which is maintained at a temperature of approximately 0° C. The drum rotates about a horizontal axis and serves to tumble the bags in the coolant and thereby promote cooling. After cooling, a door into the drum is opened. Some 20% of the bags fall out on their own, but the remainder must be removed manually.

An object of the invention is to provide a chiller which enables bags of food product to be introduced into a coolant, tumbled, and then removed after cooling, without manual handling.

BRIEF SUMMARY OF THE INVENTION

In accordance with the invention, a chiller comprises a vessel for containing a liquid coolant, an endless conveyor, means for circulating the conveyor, and means for supporting the conveyor such that a run thereof descends into the vessel to form a loop within a coolant. The means for supporting the conveyor as so defined allow the length of the loop-forming run to be lengthened and shortened, as required. When the run is lengthened it forms a loop of sufficient volume to allow bags of food product to be tumbled in the coolant in which the conveyor run is immersed. In this mode of operation, the angle of the run at each of its ends is so steep that it cannot entrain and remove bags from the coolant. Flights on the conveyor may thereby serve as the means for causing the coolant to circulate and tumble the bags within the confines of the loop. When the loop-forming run is shortened, the loop becomes relatively shallow, and the run may serve to entrain and remove the bags from the coolant.

In a preferred embodiment of the invention, the loop-forming run passes over spaced-apart rollers, each of which is drivable in opposite directions, and at least one of which is drivable at two speeds at least, so as to allow a differential speed to be established between the two rollers. Rotation of the rollers so as to circulate the conveyor in one direction allows a second run of the conveyor (adjoining the loop-forming run) to be used to transport bags into the vessel during an initial phase of operation, where they accumulate in the space within the loop. Continued circulation of the conveyor may then be used to circulate the coolant and tumble the accumulated bags. Because of the steepness of the ends of the loop, the conveyor cannot entrain and remove the bags during this phase of operation. When the temperature of the bags has been reduced to a desired level, the rollers may be driven at different speeds so as to shorten the length of the run extending between them. When the desired reduction in the length of the run has been achieved, the rollers may again be driven at equal speeds. This reduction in the size of the loop and the gentle slope of the run at its ends during this latter phase allows the conveyor to entrain the bags and carry them out of the vessel. This latter phase of operation may be carried out with the conveyor circulating in the opposite direction to that during the first phase, in which case the bags are removed from the vessel on the same side as that at which they entered it. Alternatively, the latter phase may be carried out with the conveyor circulating in the same direction as during the initial phase, so that the bags are removed from the opposite side of the conveyor to that at which they entered it. Other arrangements may be used to lengthen and shorten the loop-forming run, and are contemplated by the invention. Thus, for example, one of the rollers supporting this run may be movable towards and away from the other roller.

It will be appreciated that any reduction in the length of the loop-forming run will be accompanied by an increase in the length of another run of the conveyor, so necessitating some means for taking up slack. Conveniently, an hydraulic or pneumatic ram mechanism is provided to support a further roller over which the conveyor passes. As the loop is shortened, the ram is extended to displace the further roller by the appropriate distance and prevent slack forming. Although it is preferred to use the conveyor to cause circulation of the coolant, other means may be used for this purpose and the conveyor used just to load and unload (or even just unload) the chiller.

DETAILED DESCRIPTION OF THE INVENTION

Figure 1:
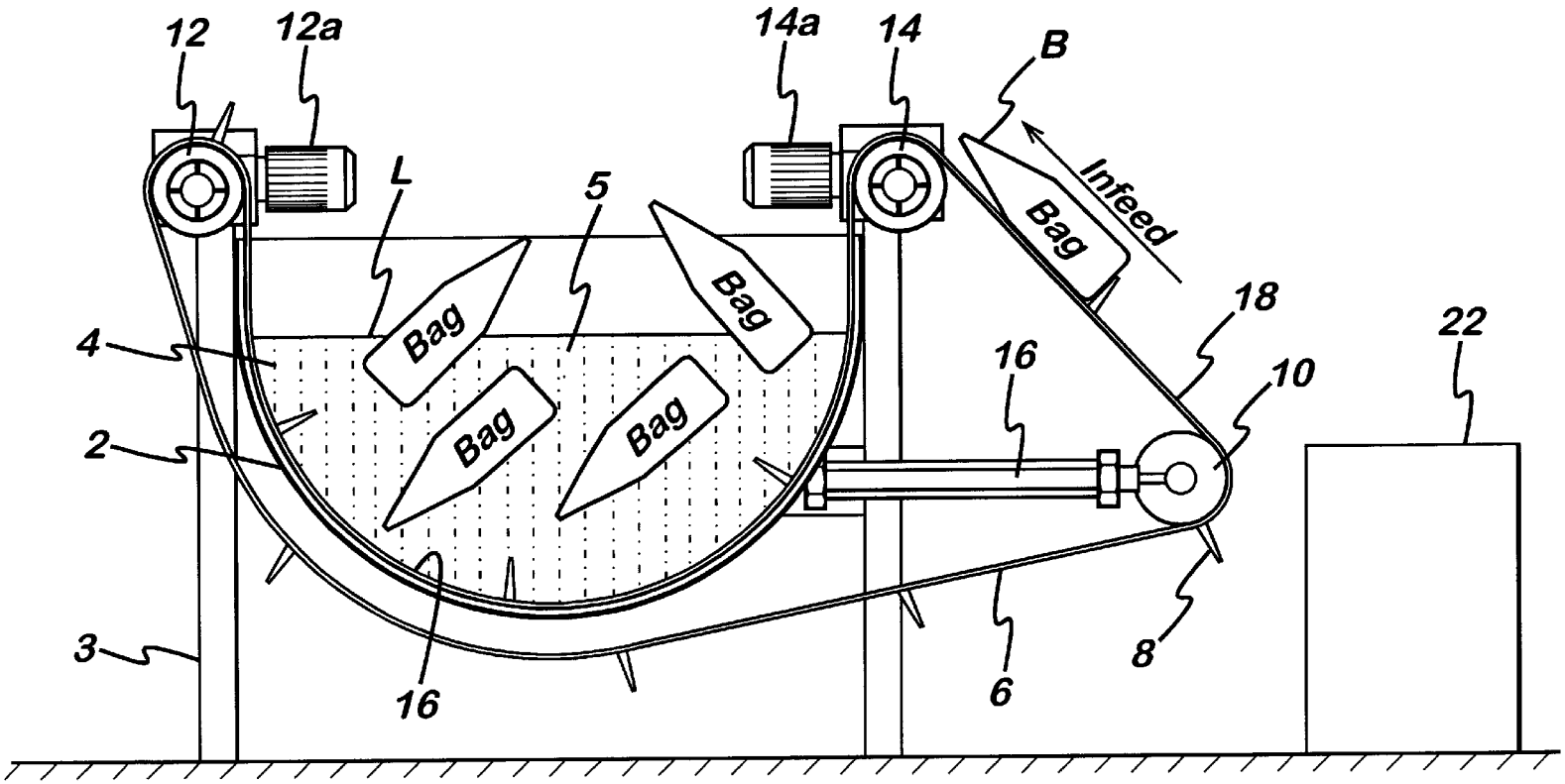
FIG. 1 is a diagrammatic vertical section through a first embodiment of chiller to illustrate operation in the loading and tumbling phases.
Figure 2:
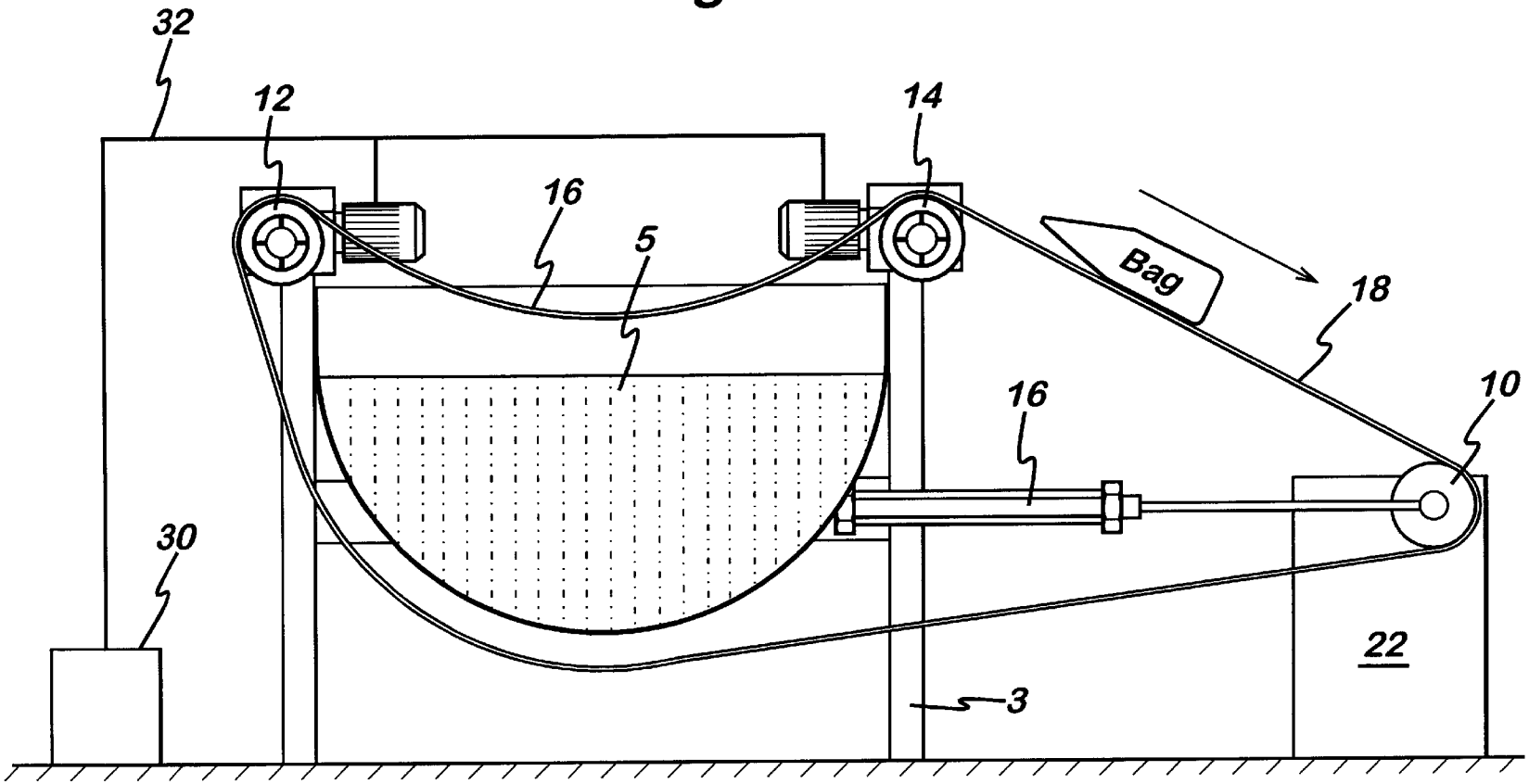
FIG. 2 is a view similar to FIG. 1 but illustrating the unloading phase.

Referring to FIG. 1 and FIG. 2 of the drawings, a first embodiment of chiller comprises a substantially semi-cylindrical vessel 2 supported on a frame 3. The vessel contains coolant conveniently water 4 at 0° C. having a level L. The vessel 2 is provided with dimpled jacket 5 to promote heat exchange with a refrigerant passing through the jacket to maintain the water at this temperature. An endless conveyor 6 has transverse flights 8 projecting therefrom. The conveyor passes around a roller 10, a roller 12 at one side of the vessel and a roller 14 at the other side of the vessel. The rollers 12 and 14 are journalled in the frame and are driven by independent, reversible electric motors 12*a* and 14*a* both mounted on the frame. Between the rollers 12 and 14 the conveyor falls in an unsupported, hanging loop 16 within vessel 2. Between rollers 10 and 12 the conveyor passes beneath the vessel. Between the roller 10 and the roller 14, the conveyor slopes upwardly in a run 18 extending from a bag filling station 22 to the vessel. The roller 10 is supported by a pair of pneumatic or hydraulic rams 16 mounted at one end on the frame.

A controller 30 (FIG. 2) is provided in the electric circuit 32 for the electric motors 12*a* and 14*a*, to selectably drive the rollers 12 and 14 at the same speed, to drive the roller 12 faster than roller 14 or to drive the roller 14 faster than the roller 12, and to drive the motors in either direction. When the rollers 12 and 14 are driven at the same speed, whatever the length of the loop 16 is, that length is maintained. In the state shown in FIG. 1, the loop 16 is of substantial depth whereas in the state shown in FIG. 2 the loop 16 is relatively shallow. To progress from the state shown in FIG. 1 to that shown in FIG. 2 the trailing roller (considered in the direction of conveyer circulation) must be driven slower than the leading roller. When the transition has taken place, the speed of the rollers 12 and 14 is returned to matching values. To return from the state shown in FIG. 2 to that of FIG. 1, the trailing roller must be driven faster than the leading roller.

In a first or loading phase of operation, depicted in FIG. 1, the rollers 12 and 14 are driven in rotation so as to cause the conveyor to circulate in a counter-clockwise direction. Bags B are filled with hot food product and sealed at filling station 22 and are loaded onto the run 18, and conveyed upwardly by engagement with the conveyor flights until they pass over roller 14 and fall into the bath of coolant contained within the loop 16. In this phase of operation, the ends of the run which constitutes the loop are generally vertical where they meet the rollers 12 and 14, and the flights are so designed (either in terms of size or flexibility) that they cannot lift the bags out of the vessel over roller 12. During a succeeding second or tumbling phase the flights cause the coolant to circulate and tumble the bags, or may cause the bags to tumble by making direct contact with them. This tumbling action promotes cooling. It will be appreciated that the first and second phases overlap, the bags being tumbled in the coolant immediately after they enter it.

When the food product has been cooled to a desired temperature, the rollers are driven in reverse so as to circulate the conveyor in the clockwise direction, with the roller 12 rotating more slowly than roller 14 during a third phase of operation, thereby to shorten the run of the conveyor which constitutes the loop 16. This results in the loop becoming shallower and its ends becoming less steep. At the same time, the rams 16 are extended so as to take up slack in the remainder of the conveyor. When the position depicted in FIG. 2 is reached, the rollers 12 and 14 are driven at the same speed and during this fourth or unloading phase (and, possibly, to some extent while the loop is being shortened) the conveyor flights (omitted from FIG. 2) entrain the bags and remove them from the vessel along run 18. Of course, the conveyor may be circulated in the clockwise direction during the second phase after the chiller has been loaded, or it may be circulated alternately in one direction and then the other during the second phase.

Figure 3:
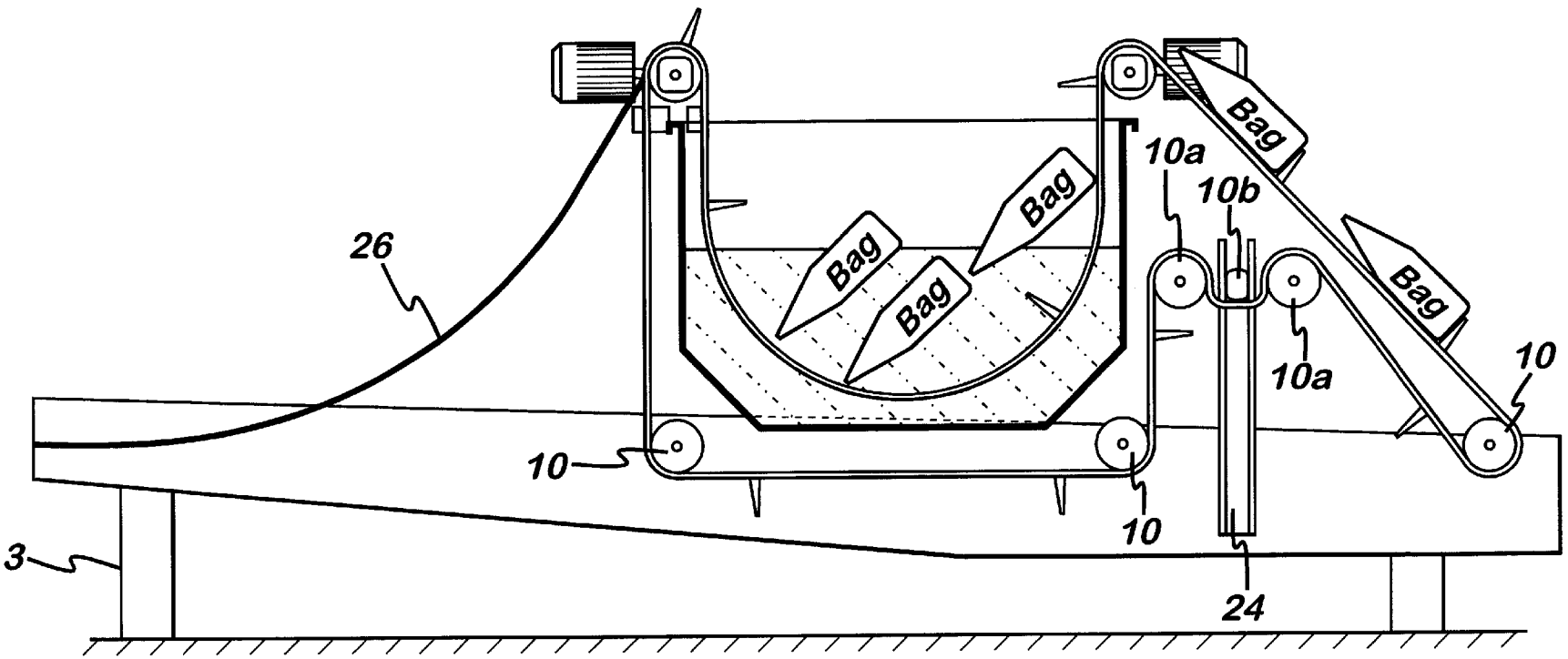
FIG. 3 is a view similar to FIG. 1 but of a second embodiment during the loading phase.

In the embodiment shown in FIG. 3, the arrangement is generally similar to FIGS. 1 and 2 but externally of the vessel the conveyor passes around a series of rollers 10, 10*a* and 10*b* and slack in the conveyor is taken up by biasing a roller 10*a* downwards along a track 24 disposed between rollers 10*a*. Also, the conveyor continues to be driven in the counter-clockwise direction during all phases so that the bags are lifted out of the vessel at its left hand side and are conveyed away from the chiller along a chute 26 during the unloading phase.

It will be understood that the rollers 12 and 14 may alternatively be driven from a single source of motive power, gearing being provided to vary the relative speeds of rollers 12 and 14. The conveyor may be in the form of a continuous belt or, more preferably, assembled from inter-articulated plastics sections which are perforated so as to prevent coolant being carried out of the vessel as the conveyor emerges from it. Other means for changing the length of the loop 16 also fall within the scope of the invention, for example, an arrangement to adjust the position of one of the rollers 12, 14 relative to the other.

Although the invention is preferably carried out using flights extending the width of the conveyor, it falls within the scope of the invention for the conveyor to be provided with any other type of formation which is capable of entraining the bags and introducing them into and removing them from the vessel and producing a tumbling action.

The rollers may be of any construction suitable for interengaging with the conveyor, and the term "roller" is to be understood to include spaced-apart toothed wheels cooperating with racks on the conveyor, for example. Although it is convenient for the bags to be delivered to the chiller along a run of the conveyor, they may be delivered to the chiller in any other way, for example, by a separate conveyor or down a chute.

What is claimed is:

1. A chiller comprising a vessel for coolant, an endless conveyor having transverse flights for transporting articles, said conveyor passing in a loop from one side to another of the vessel, means being provided to alter the path of the conveyor so as to shorten and lengthen the loop so that, in use, when the loop is lengthened articles are tumbled in the coolant by the flights, and when the loop is shortened articles are conveyed out of the vessel.

2. A chiller comprising a vessel for coolant, a system for maintaining the temperature of the coolant at a desired level, an endless conveyor having a run constituting a loop which descends into the vessel, drive means for causing the endless conveyor to circulate, and means for lengthening and shortening the said run thereby to respectively increase and decrease the size of the loop, the chiller having a phase of operation in which the size and shape of the loop are such that articles to be cooled and deposited in coolant within the loop are tumbled in coolant within the loop but are not entrained by the conveyor and removed from the vessel, and a further phase of operation in which the shape of the loop is such that such articles are entrained and removed from the vessel by the conveyor.

3. A chiller as claimed in claim 2, wherein the drive means includes two rollers arranged one at each end of the loop and drive motors for driving the rollers selectably at different speeds.

4. A chiller as claimed in claim 3, wherein the conveyor includes a run external to the vessel for conveying articles into the vessel and along which articles are unloaded from the vessel.

5. A chiller as claimed in claim 4, wherein the conveyor is unsupported inside the vessel.

6. Food processing apparatus comprising:

a) a packing station for filling bags with food product, b) a chiller including:

(i) a support frame and a vessel for coolant supported on the frame, (ii) heat exchange means for maintaining the coolant at a temperature of substantially 0° C., (iii) an endless conveyor encircling the vessel, (iv) first and second drive rollers for the conveyor arranged in spaced-apart positions adjacent the upper side of the vessel, the conveyor having a run which forms a hanging loop between the rollers, said loop descending into the vessel, (v) drive motors for the drive rollers, (vi) control means for the motors, said control means being arranged to cause the motors to run firstly at the same speed and secondly at different speeds, thereby to vary the size and shape of the loop, (vii) formations on the conveyor for transporting filled bags therealong and for causing bags to tumble in coolant within the vessel, (viii) the conveyor including a further run for delivering cooled bags from the chiller, (ix) a further roller engaging the conveyor externally of the vessel, said further roller being supported by extensible ram means for taking up slack in the conveyor during shortening of the loop, (x) the conveyor run constituting the loop having an unloading condition in which the formations on the conveyor transport bags out of the vessel and onto the further run, and an alternative tumbling position in which said formations are incapable of so transporting the bags, c) loading means for delivering filled bags from the packing station to the chiller.

7. Apparatus as claimed in claim 6, wherein said loading means is constituted by said further run, the drive motors being reversible so as to circulate the conveyor in the reverse direction during unloading.

8. A method of cooling packaged food product, wherein packages of hot food products are deposited in a bath of coolant contained within a vessel, an endless conveyor forming a loop within the coolant, packages deposited in the coolant being contained within the loop, circulation of the conveyor causing the packages to tumble in the coolant, and upon the packages being cooled to a desired temperature the run constituting the loop being reduced in length and depth so that it entrains and removes packages from coolant.

* * * * *